US010117529B2

(12) United States Patent
Abel

(10) Patent No.: US 10,117,529 B2
(45) **Date of Patent: *Nov. 6, 2018**

(54) THREE SIDE SHOPPABLE QUICK ASSEMBLING DISPLAY HUTCH

(71) Applicant: Sonoco Development, Inc., Hartsville, SC (US)

(72) Inventor: Patrick Abel, Crescent Springs, KY (US)

(73) Assignee: Sonoco Development, Inc., Hartsville, SC (US)

( * ) Notice: Subject to any disclaimer, the term of this patent is extended or adjusted under 35 U.S.C. 154(b) by 126 days.

This patent is subject to a terminal disclaimer.

(21) Appl. No.: 15/373,902

(22) Filed: Dec. 9, 2016

(65) Prior Publication Data

US 2018/0160825 A1 Jun. 14, 2018

(51) Int. Cl.

| | |
|---|---|
| ***A47F 5/00*** | (2006.01) |
| ***A47F 5/11*** | (2006.01) |
| ***A47B 43/02*** | (2006.01) |
| ***F16B 47/00*** | (2006.01) |
| ***A47B 47/06*** | (2006.01) |
| ***B65D 5/52*** | (2006.01) |
| ***A47B 55/06*** | (2006.01) |

(52) U.S. Cl.

CPC ..... *A47F 5/116* (2013.01); *A47B 43/02* (2013.01); *A47B 47/06* (2013.01); *A47B 55/06* (2013.01); *A47F 5/112* (2013.01); *B65D 5/5213* (2013.01); *F16B 47/003* (2013.01); *A47F 2005/0075* (2013.01)

(58) Field of Classification Search

CPC .. A47F 5/116; A47F 5/11; A47F 5/112; A47F 5/10; A47F 5/0018; A47F 5/114; A47F 2005/0075; A47B 43/02; A47B 47/06; A47B 55/06; A47B 43/00; A47B 2220/008; B65D 71/72; B65D 5/48044; B65D 5/5273; B65D 5/526; B65D 85/325; B65D 5/5213; B65D 5/725; B65D 5/4204; B65D 5/724; F16B 47/003

USPC ..... 206/736, 738, 745, 746, 747, 748, 756, 206/763, 769, 772, 774; 229/120.14, 229/120.15, 120.32, 121, 122, 120.06, 229/120.11, 120.25, 120.26, 120.29, 229/162.6; 211/135, 149, 72, 73; 108/165

See application file for complete search history.

(56) References Cited

U.S. PATENT DOCUMENTS 1,838,997 A * 12/1931 Levine ..... B65D 85/325 206/521.1
RE18,639 E * 11/1932 Levine ..... B65D 85/325 206/521.1
1,958,569 A * 5/1934 Einson ..... A47F 5/112 40/539

(Continued)

OTHER PUBLICATIONS

U.S. Appl. No. 15/267,751, filed Sep. 16, 2016 entitled "Two Piece Collapsible Display Hutch".

*Primary Examiner* — Hiwot E Tefera
(74) *Attorney, Agent, or Firm* — Miller, Matthias & Hull LLP

(57) ABSTRACT

A display hutch is provided that can be made from three components adhered together to form a flat compact structure suitable for shipping. The compact structure can be positioned upright and converted into the display hutch by pushing down on support halves or by rotating inwardly side shelf panels and front shelf panels.

11 Claims, 10 Drawing Sheets

(56) References Cited

U.S. PATENT DOCUMENTS 2,983,427 A * 5/1961 Glaser ..... B65D 85/325 206/521.4
3,246,827 A * 4/1966 Walter ..... B65D 85/325 206/521.4
3,372,813 A * 3/1968 Ishida ..... A47F 5/116 211/135
3,987,737 A * 10/1976 Smith ..... A47F 5/116 108/179
4,089,457 A * 5/1978 Wood ..... B65D 5/48044 229/120.15
4,618,115 A * 10/1986 Belokin, Jr. ..... A47F 5/116 211/135
4,630,740 A * 12/1986 Belokin, Jr. ..... A47F 5/116 211/194
4,854,246 A * 8/1989 Belokin ..... A47F 5/116 108/162
5,213,220 A * 5/1993 McBride ..... A47B 43/00 211/126.16
5,538,131 A * 7/1996 Harrelson ..... B65D 71/0022 206/162
5,678,492 A * 10/1997 Pinkstone ..... A47B 43/02 108/165
7,677,433 B2 3/2010 Little
7,703,864 B2 4/2010 Moser
8,875,908 B2 * 11/2014 L'Hotel ..... A47F 5/116 211/135
9,918,569 B1 * 3/2018 Abel ..... A47F 5/112
2010/0181443 A1 * 7/2010 Bojie ..... A47F 5/11 248/146
2011/0049072 A1 * 3/2011 Dewhurst ..... A47F 5/116 211/135
2016/0066711 A1 * 3/2016 Mestres Armengol ..... A47F 5/116 211/135

* cited by examiner

THREE SIDE SHOPPABLE QUICK ASSEMBLING DISPLAY HUTCH

BACKGROUND OF THE INVENTION

Field of the Invention

This disclosure relates to a display hutch. More particularly, this disclosure relates to a display hutch made from three die cut blanks adhered together to form a flat compact structure suitable for shipping. The compact structure can be positioned upright and quickly converted into a display hutch by pushing down on two support members.

Description of the Related Art

Floor stands (a.k.a. display hutches) having multiple shelves for supporting products are well known. Typically display hutches are made of multiple components and sometimes even require fasteners. Display hutches can also require complex assembly steps, and can be large even when knocked down. The present disclosure is designed to solve these problems.

BRIEF SUMMARY OF THE INVENTION

The present disclosure relates to a display hutch that can be made from three components adhered together to form a flat compact structure suitable for shipping. The compact structure can be positioned upright and converted into the display hutch by pushing down on support halves or by rotating inwardly (as by pushing) side shelf panels and then pushing inward the front shelf panels.

In one aspect the disclosure relates to a display hutch comprising a front panel, two side panels, a rear panel and an internal support. The front panel comprises a front body panel that defines a plurality of windows and one or more front shelf panels rotatably attached to the front body panel along fold lines. Each side panel abuts the front panel along a front corner. A left side panel comprises a left side body panel and one or more left side shelf panels. Each left side shelf panel is rotatably attached to the left side body panel along a fold line. Similarly, a right side panel abuts the front panel along a right front corner. The right side panel comprises a right side body panel and one or more right side shelf panels. Each right side shelf panel is rotatably attached to the right side body panel along a fold line. A glue tab is hingedly attached to each side shelf panel along a glue tab fold line. The rear panel abuts the left side panel along a left rear corner and abuts the right side panel along a right rear corner. The rear panel defines rear cutouts corresponding to each side shelf panel. The rear panel has a rear cutout edge along a bottom side of each rear cutout. The hutch comprises one or more shelves, each shelf having a load bearing surface and comprising one of the front shelf panels and two of the side shelf panels. The internal support comprises left and right support halves. The left support half is adhered to each of the left side glue tabs, and the right side support half is adhered to each of the right side glue tabs.

In another aspect of the disclosure a first blank is disclosed comprising a front panel, a left side panel, a right side panel and a rear panel. The front panel has a left vertical edge and a right vertical edge and comprises a front body panel and one or more front shelf panels. Each front shelf panel is attached to the front body panel along a front shelf fold line. The left side panel is attached to the front panel along the left vertical edge and comprises a left side body panel and one or more left side shelf panels. Each left side shelf panel is hingedly attached to the left side body panel along a side shelf fold line. The left side panel further comprises a left side glue tab hingedly attached to each left side shelf panel along a glue tab fold line. The right side panel is attached to the front panel along the right vertical edge and comprises a right side body panel and one or more right side shelf panels. Each right side shelf panel is hingedly attached to the right side body panel along a right side shelf fold line. The right side panel further comprises a right side glue tab hingedly attached to each right side shelf panel along a glue tab fold line. The rear panel is attached to at least one of the side panels along a vertical edge. The rear panel may define rear cutouts corresponding to each side shelf panel.

DETAILED DESCRIPTION OF THE INVENTION

Figure 1:
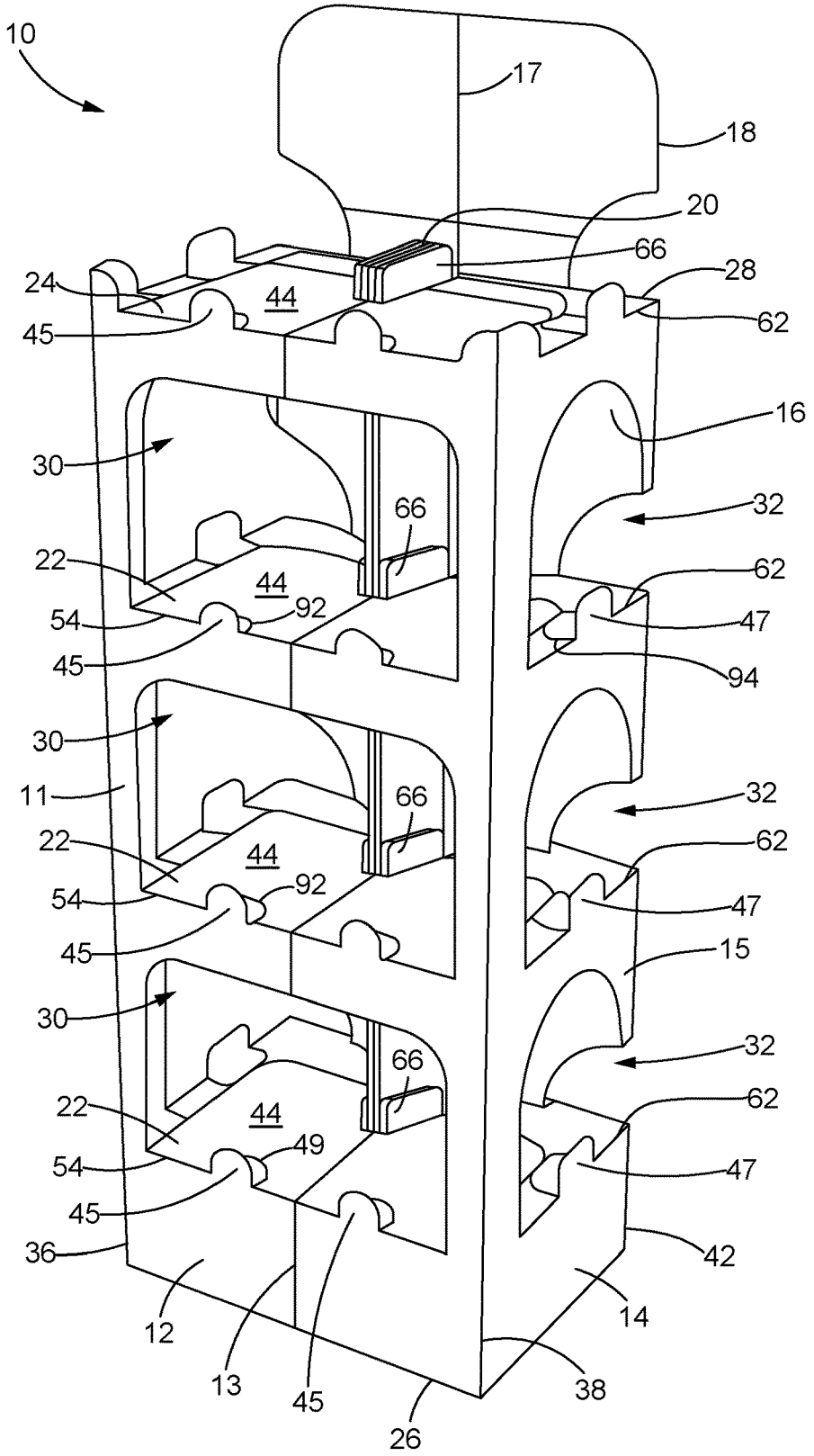
FIG. 1 is a perspective view of a display hutch according to the disclosure.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

As will be appreciated, terms such as "above" and "below", "upper" and "lower", "left" and "right", "top" and "bottom," "front" and "back," (etc.), used as nouns, adjectives or adverbs refer in this description to the orientation of the structure of the hutch as it is illustrated in the various views. Such terms are not intended to limit the invention to a particular orientation.

Turning to the drawings, where like numerals indicate like elements, there is shown in FIG. 1 a perspective view of a display hutch 10 according to the disclosure. The hutch 10 comprises a front panel 12, two side panels 14, a rear panel 16 including a header 18, an internal support 20, one or more shelves 22 and a top shelf 24. Each shelf 22 and the top shelf 24 may have a load bearing surface and corresponds to a level. The top shelf 24 may support products like the other shelves 22 or may simply serve to cover the topmost shelf 22. The hutch 10 shown in FIG. 1 has four levels, although the hutch 10 may be made with any number of levels.

The hutch 10 generally extends vertically (bottom to top) from a bottom edge 26 to a top edge 28, although some parts of the hutch 10, such as the header 18, may extend above the top edge 28. The header 18 is an integral part of the rear panel 16 and, as noted, may extend upwardly above the top shelf 24. Like any other surface of the hutch 10, the header 18 may bear graphics and other information about the products on display.

The hutch 10 may be a substantially rectilinear structure and has four vertical corner edges, namely, a left front corner edge 36, a right front corner edge 38, a left rear corner edge 40 and a right rear corner edge 42. The front panel 12 of the hutch 10 extends laterally from the left front corner edge 36 to the right front corner edge 38. The left side panel 14 extends front to back from the left front corner edge 36 to the left rear corner edge 40. The right side panel 14 extends front to back from the right front corner edge 38 to the right rear corner edge 42. And the rear panel 16 extends laterally from the left rear corner edge 40 to the right rear corner edge 42.

The front panel 12 comprises a front body panel 11 that defines a plurality of openings or windows 30 through which products may be seen and accessed. Likewise, each side panel 14 may define a plurality of openings or windows 32 through which the products may be seen and accessed. On the other hand, the rear panel 16 typically does not have windows, although it may have rear cutouts 72. Thus, the display hutch 10 may present three "shoppable" sides, that is, three sides through which products may be seen and accessed.

The front body panel 11 may include upwardly projecting front tabs 45 at each level to help hold products or a tray full of products on the respective shelves 22.

Likewise, each side panel 14 may include upwardly projecting side tabs 47.

Each shelf 22 may comprise three separate panels: a front shelf panel 44 and two side shelf panels 46 (obscured in FIG. 1 by the front shelf panels 44). Each front shelf panel 44 is hingedly connected to the front body panel 11 along a front shelf fold line 54 and may be supported at its distal (free) edge by the internal support 20. Each side shelf panel 46 is hingedly connected to a side body panel 15 along a side shelf fold line 62 and may be supported along a rear edge by the rear panel 16 and, more specifically, by a rear cutout edge 74 of the rear panel 16. Thus, each shelf 22 includes areas of double thickness and is supported by the front body panel 11, the side body panels 15, the rear panel 16 and the internal support 20.

The internal support 20 is substantially long and narrow and extends vertically at the rear of the shelves 22 but in front of the rear panel 16. The internal support 20 is made from two blanks 88 and so is two layers thick. Each second blank 88 is adhered to a side panel 14 and, more specifically, to glue tabs 66 that are hingedly affixed to every side shelf panel 46 as well as the top panel 48 of that particular side panel 14. As the display hutch 10 is erected the two second blanks 88 come together in the middle rear of the structure to form the internal support 20. The second blanks 88, and thus the internal support 20, may define a series of vertically arranged notches 86 (better seen in FIG. 3) which engage the front shelf panels 44 to lock them into a horizontal configuration as explained further below.

First Blank 50

Figure 2:
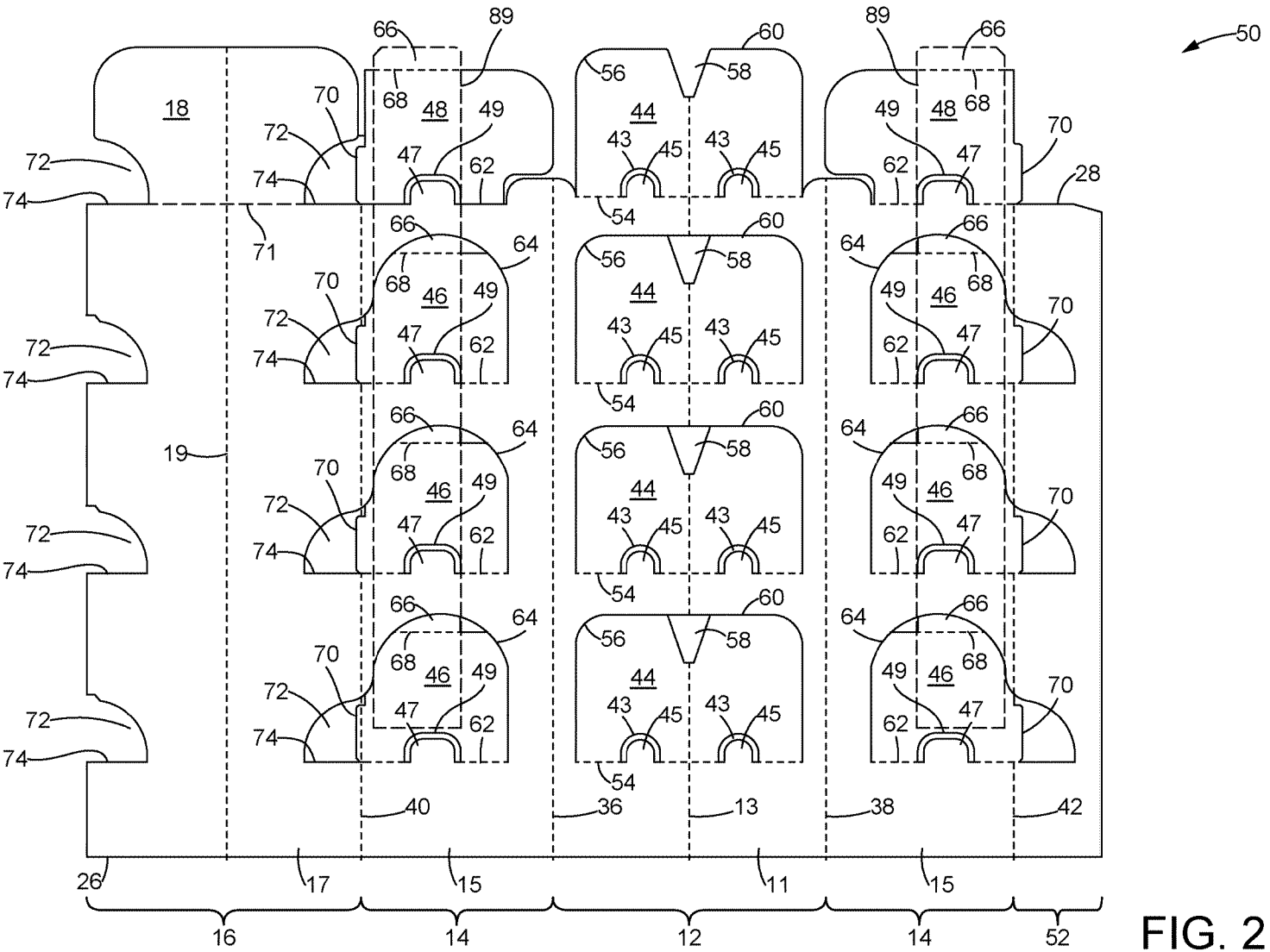
FIG. 2 is a plan view of a first blank used to make the display hutch of FIG. 1.

FIG. 2 is a plan view of a first blank 50 used to make the display hutch 10 of FIG. 1. The first blank 50 extends from a bottom edge 26 to a top edge 28 and comprises four major panels and a glue panel 52. The four major panels are the front panel 12, the two side panels 14 and the rear panel 16.

The front panel 12 is attached to one side panel 14 by a first fold line 36 corresponding to the left front corner edge 36 and to the other one side panel 14 by a second fold line 38 corresponding to the right front corner edge 38.

The left side panel 14 may be attached to the front panel 12 by the first fold line 36 corresponding to the left front corner edge 36 and to the rear panel 16 by the third fold line 40 corresponding to the left rear corner edge 40. The right side panel 14 may be attached to the front panel 12 by the second fold line 38 corresponding to the right front corner edge 38 and to the glue panel 52 by the fourth fold line 42 corresponding to the right rear corner edge 42 in the finished hutch 10.

Of course, other arrangements of the major panels are possible. The glue panel 52 may be foldably attached to any major panel and may be affixed with glue or other adhesive to a different major panel. For example, the glue panel 52 may be foldably attached to the rear panel 16 and upon assembly of the hutch 10 affixed to the right side panel 14. Also, the major panels can be arranged with both side panels 14 foldably attached to the rear panel 16. It should be understood that this disclosure is not limited to the particular panel arrangement shown in the drawings.

Still referring to FIG. 2, the front panel 12 comprises a ladder shaped front body panel 11 and one or more front shelf panels 44. Each front shelf panel 44 is attached to the front body panel 11 along a horizontal front shelf (fifth) fold line 54. Each front shelf panel 44 may be further defined by a substantially U-shaped cut line 56 that extends upwardly from one end of the front shelf fold line 54 to the opposite end. Each front shelf panel 44 may be substantially rectangular, and may define a (preferably V-shaped) cutout 58 along its distal (rear) edge 60, i.e., along the top portion 60 of the cut line 56. A front fold line (front knockdown score) 13 may vertically bisect the front panel 12.

Each side panel 14 may comprise a side body panel 15, one or more side shelf panels 46 and a side top panel 48. Each side shelf panel 46 and the side top panel 48 may be attached to the side body panel 15 along a horizontal side shelf (sixth) fold line 62. At each level of the hutch 10, the side shelf fold lines 62 may be co-linear with the front shelf fold lines 54. The side shelf panels 46 may be further defined by U-shaped cut lines 64.

A glue tab 66 may be attached to each side shelf panel 46 and the side top panel 48 along a glue tab fold line 68. The glue tabs 66 are configured to be adhered to the second blanks 80 as explained below.

Each side shelf panel 46 and the side top panel 48 may also include a side flange 70 which projects (extends) rearward and is supported by the rear panel 16 in the finished hutch 10.

The rear panel 16 includes a rear body panel 17 and the header 18 separated by an optional horizontal rear panel fold line 71. A rear knock down score line or fold line 19 may vertically bisect the rear panel 16. At each level of the hutch 10, the rear panel 16 may define rear cutouts 72 having cutout edges 74 that are co-linear with the side shelf fold lines 62. The side flanges 70 of each side shelf panel 46 and side top panel 48 extend into the rear cutouts 72 so that, when the side shelf panels 46 and side top panels 48 are rotated downward about side shelf fold lines 62 until they are in a horizontal orientation, the side flanges 70 rest on and are supported by the bottom cutout edges 74.

The first blank 50 may include upwardly projecting front tabs 45 and side tabs 47. More specifically, each front shelf fold line 54 may be interrupted by one or more substantially semicircular front tab score lines 43 to create one or more front tabs 45. Each side shelf fold line 62 may be interrupted by one or more substantially semicircular side tab score lines 49 to create one or more side tabs 47.

During assembly of the hutch 10, the two support halves 88 are glued to the first blank 50 in the positions indicated by the dashed lines 89 in FIG. 2.

Second Blanks 88

Two second blanks 88 may be used to form the interval support 20. Each second blank 88 may be substantially rectangular and may be made from a larger blank 80 such as that shown in FIG. 3. The larger blank 80 may include a vertical score line 82 which bisects the larger blank 80 in the vertical direction.

Each second blank 88 may have a height at least as great as the distance between two of the glue tabs 66, and preferably at least as great as the distance between the bottommost glue tab 66 and the topmost glue tab 66. Each second blank 88 may have a first free edge 82 and a second free edge 84, the second free edge 84 forming half of the forward edge 84 of the internal support 20. Each free edge 84, and thus the forward edge 84 of the internal support 20, defines a series of vertically spaced apart notches 86. The notches 86 align with and engage the V-shaped cutouts 58 in the front shelf panels 44 in the assembled hutch 10.

Method of Assembly

A method of assembling the hutch 10 will now be described with reference to FIGS. 2-10.

Figure 3:
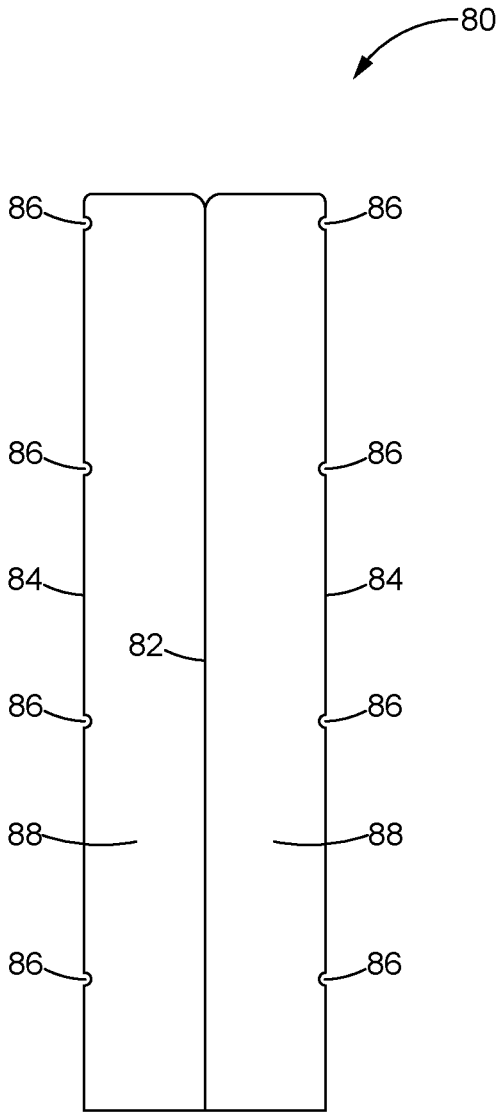
FIG. 3 is a plan view of a pair of second blanks used to make the display hutch of FIG. 1.

If the larger blank 80 of FIG. 3 is used to make the second blanks 88, then the larger blank 80 is divided into the two second blanks (support halves) 88 by separating the support helves 88 where they meet along the vertical score line 82.

Glue or other adhesive is applied to the interior (support half 88 facing) surfaces of the glue tabs 66 or, less preferably, to areas of the support halves 88 that will be adhered to the glue tabs 66. After applying the glue, the two support halves 88 are positioned onto the first blank 50 in the locations indicated by the dashed lines 89 in FIG. 2. This causes the support halves 88 to become affixed to the vertically aligned glue tabs 66 in each side panel 14 to achieve the substantially flat structure 90 shown in FIG. 4.

Figure 4:
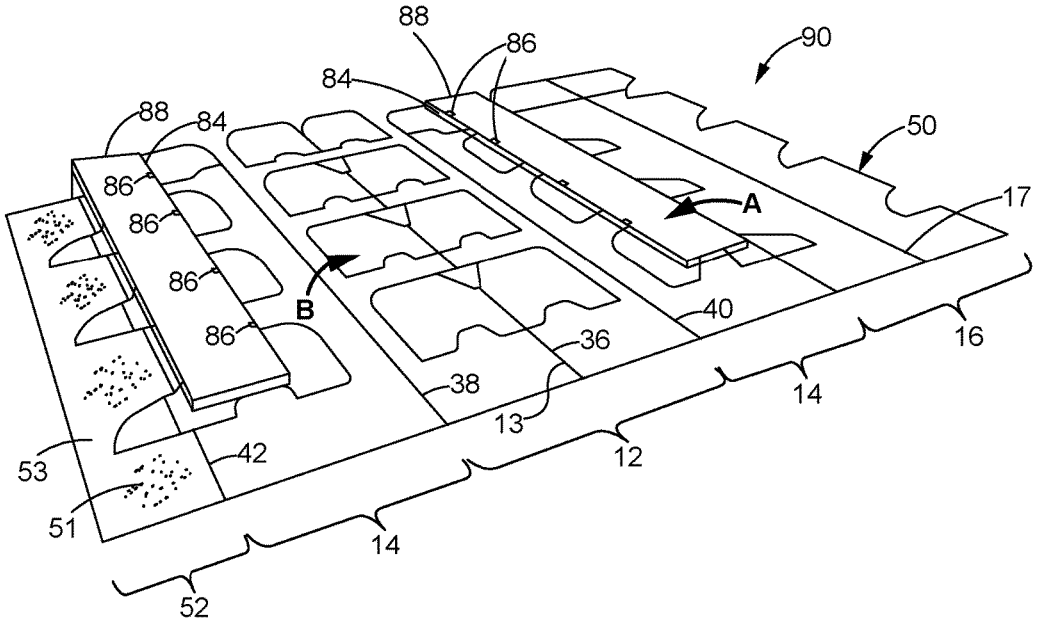
FIG. 4 is a perspective view of two second banks being affixed to the first blank to create a flat structure.

As shown in FIG. 4, glue 51 or other adhesive may be applied to the inner facing surface 53 of the glue panel 52. The flat structure 90 may be folded over along the third fold line 40 as shown by arrow A in FIG. 4 and then folded over along the second fold line 38 as shown by arrow B until the glue panel 52 lays flat against the outer facing surface of the rear panel 16 and is adhered thereto to form the glued structure 92 of FIG. 5.

Alternatively, the flat structure 90 of FIG. 4 may be first folded over along the second fold line 38 as shown by arrow B, then glue 51 is applied to the outer facing surface of the glue panel 52 (obscured in FIG. 3), then the structure 90 is folded a second time along the third fold line 40 until the rear panel 16 lays flat against the glue panel 52 and is adhered thereto.

Figure 5:
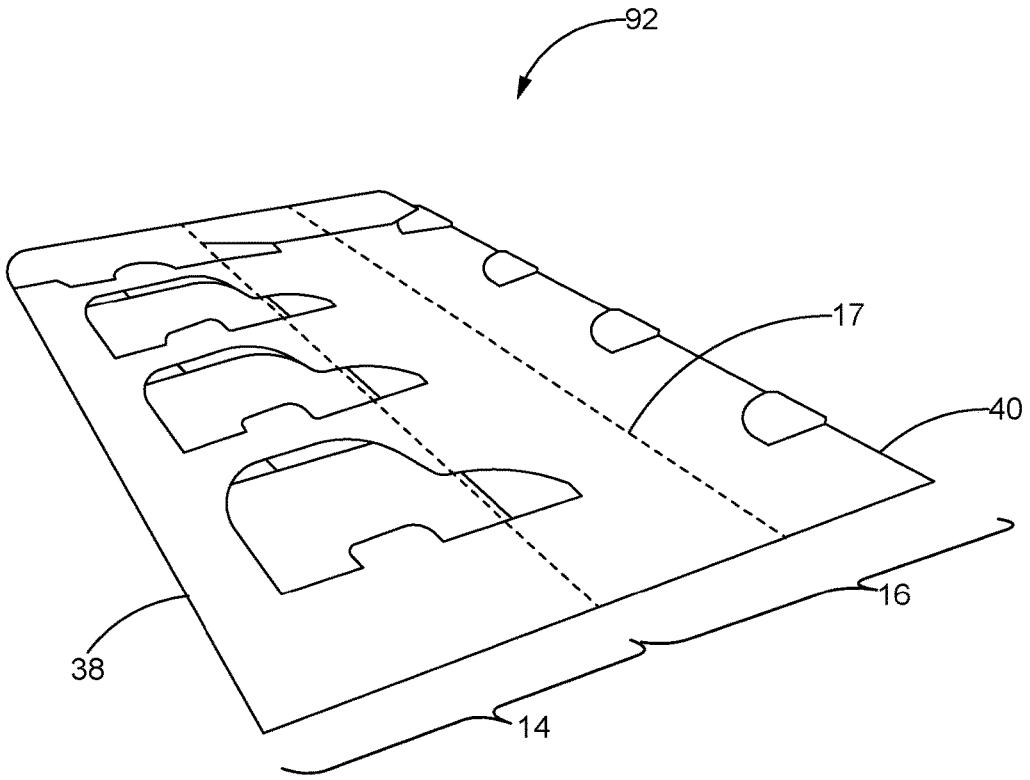
FIG. 5 is a perspective view of the flat structure of FIG. 3 after being folded and glued.

The glued structure 92 may be shipped in the configuration shown in FIG. 5. If desired, the glued structure 92 may be made even more compact. This may be achieved by squaring up (opening up) the structure 92 of FIG. 5 so that it assumes a three dimensional rectangular column shape (like that shown in FIG. 7), then pushing the front panel 12 inwardly along front knockdown score 13 and pushing the rear panel 16 inwardly along rear knockdown score 19. This pushing/folding step will cause the front panel 12 and the rear panel 16 to fold inwardly on themselves and become sandwiched between the side panels 14 to achieve the compact structure 94 shown in FIG. 6. The compact structure 94 has a width about the same as a single side panel 14 and is much more compact than most traditional hutches. The compact structure 94 may be shipped to the end user in this configuration.

Figure 6:
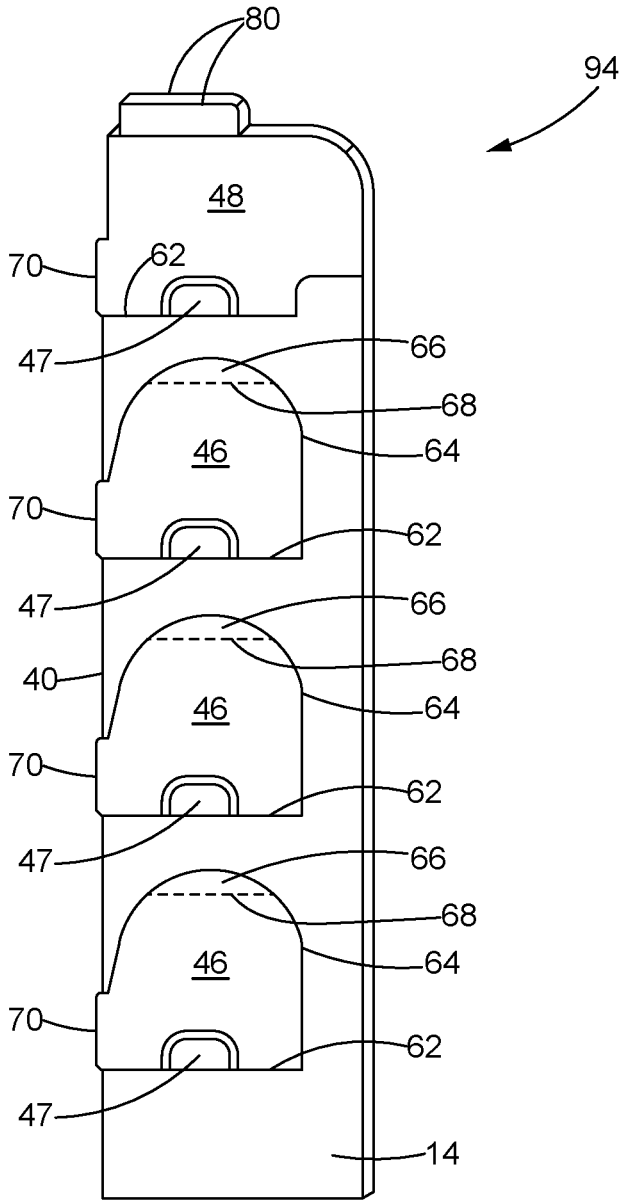
FIG. 6 is a perspective view of the structure of FIG. 5 after being further folded to form a compact structure.
Figure 7:
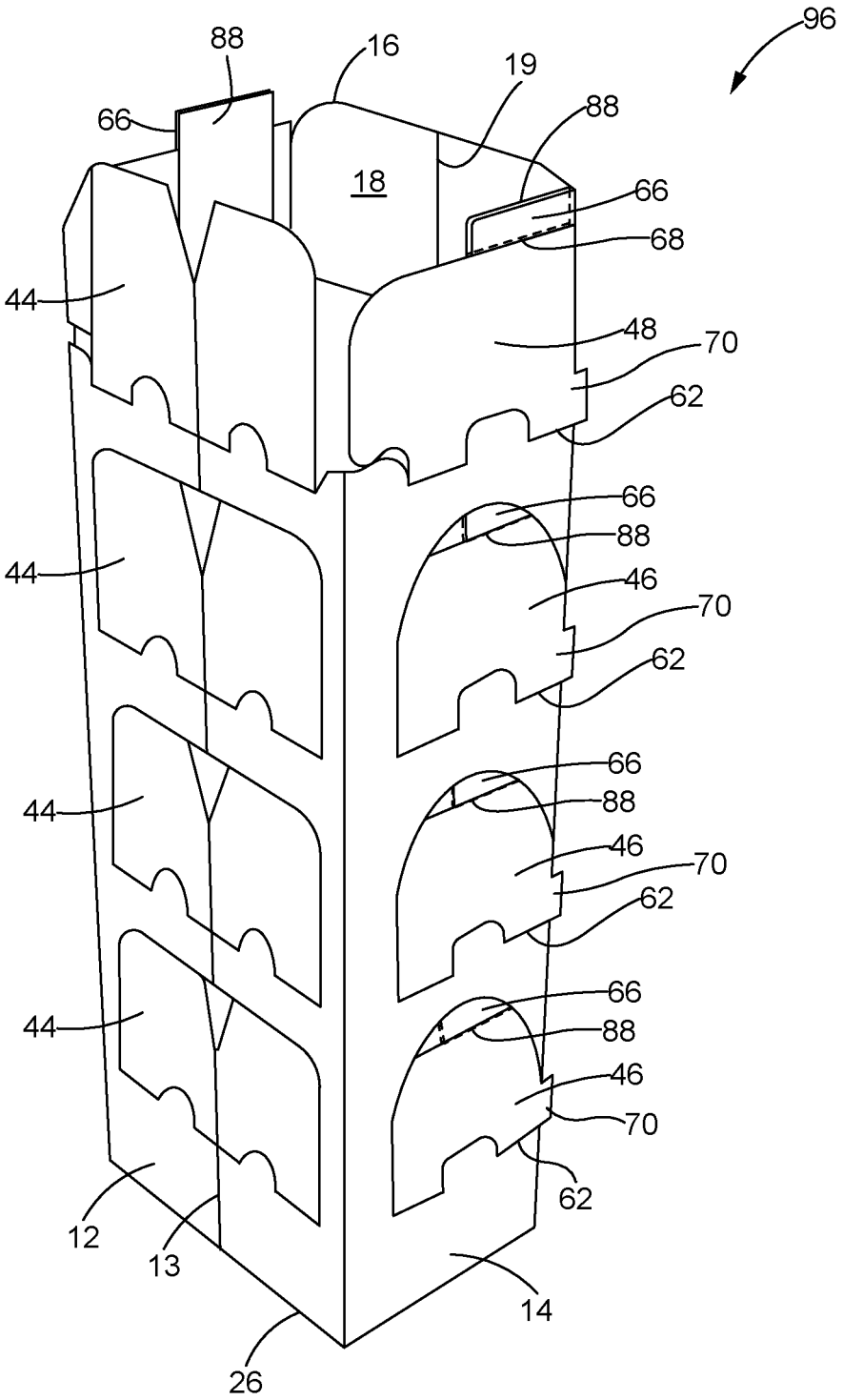
FIG. 7 is a front perspective view of the structure of FIG. 6 after being positioned upright and unfolded ("squared up") to create an upright structure.

To set up the hutch 10 at, for example, its final destination, starting with the compact structure 94 of FIG. 6, the compact structure 94 may be positioned upright and the front panel 12 and the rear panel 16 pulled outwardly to form the "squared up" three-dimensional upright structure 96 of FIG. 7. In this configuration the support halves 88 are adhered to the side panels 14 and are spaced apart by approximately the width of the structure 94.

Figure 8:
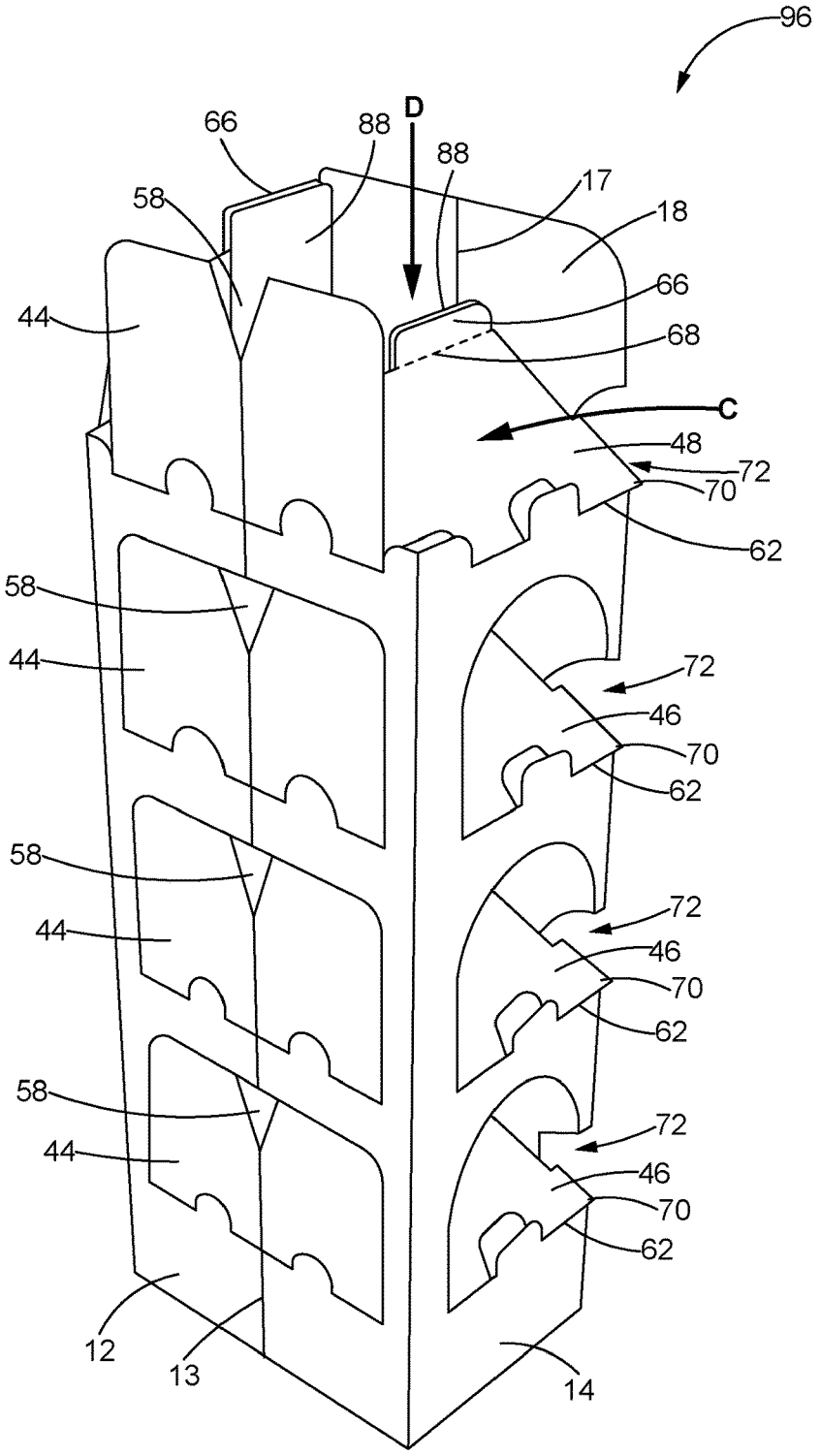
FIG. 8 is a front perspective view of the upright structure of FIG. 7 showing half of the side shelf panels being rotated into place.

Next, the side shelf panels 46 and the side top panel 48 of each side panel 14 may be rotated downwardly along sixth fold lines 62 in unison. This may be accomplished by pushing inwardly and downwardly any of the side shelf panels 46 or, most easily, the side top panel 48 along its respective fold line 62 in the direction of arrow C in FIG. 8, and/or by pushing down on the support halves 88 in the direction of arrow D. FIG. 8 is a front perspective view of the upright structure of FIG. 7 showing the side shelf panels 46 and side top panel 48 of each side panel 14 being rotated downwardly. This action brings together the two support halves 88 to form a single internal support 20 as shown in FIG. 9.

Figure 9:
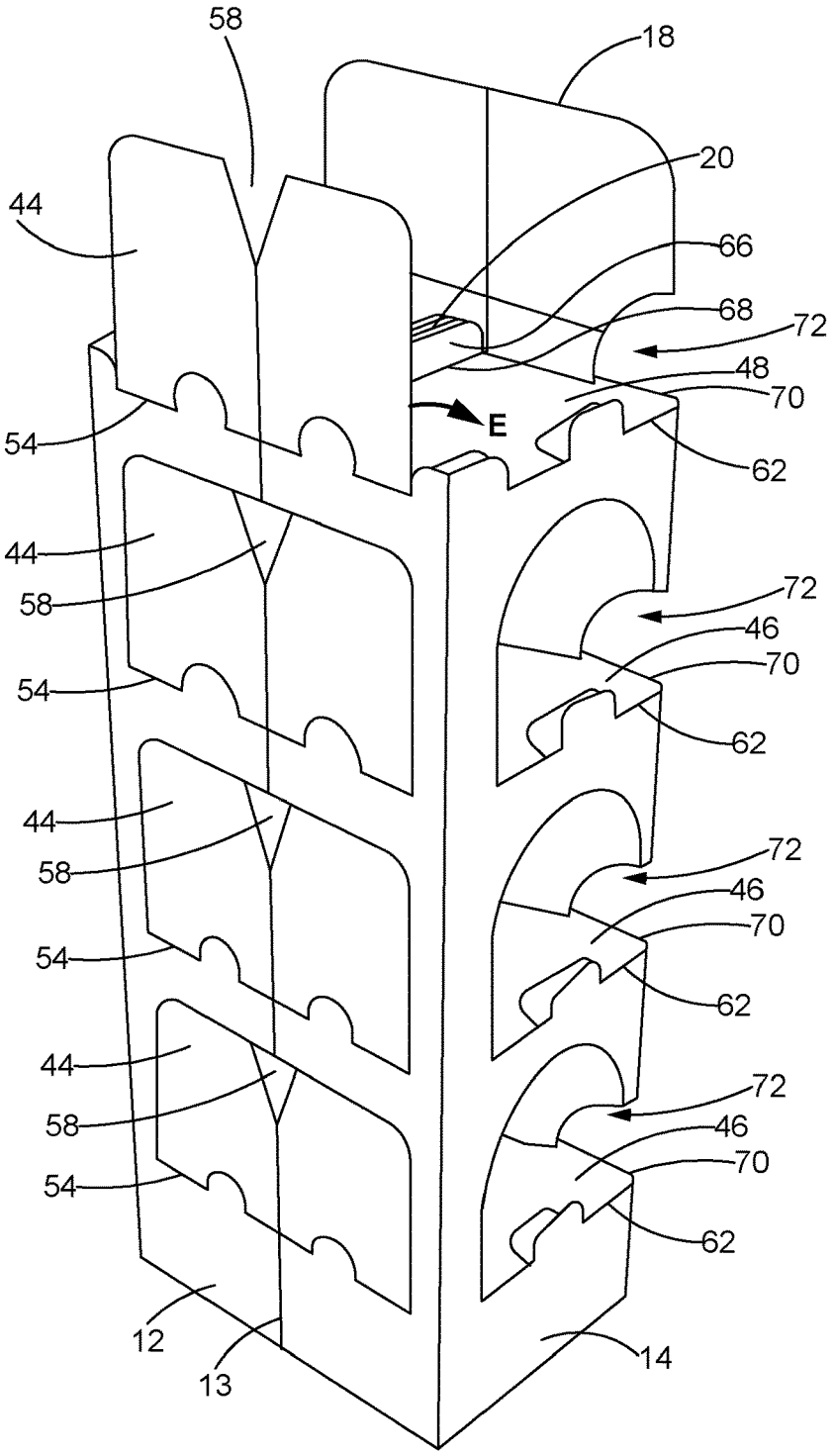
FIG. 9 is a front perspective view of the upright structure of FIG. 8 after all the side shelf panels have been rotated into place.

FIG. 9 is a front perspective view of the upright structure 96 of FIG. 8 after the side shelf panels 46 and the side top panels 48 have been folded downward into a horizontal orientation. Each side flange 70 rests on and is supported by a rear cutout edge 74 creating stability toward the back of each shelf 22.

Figure 10:
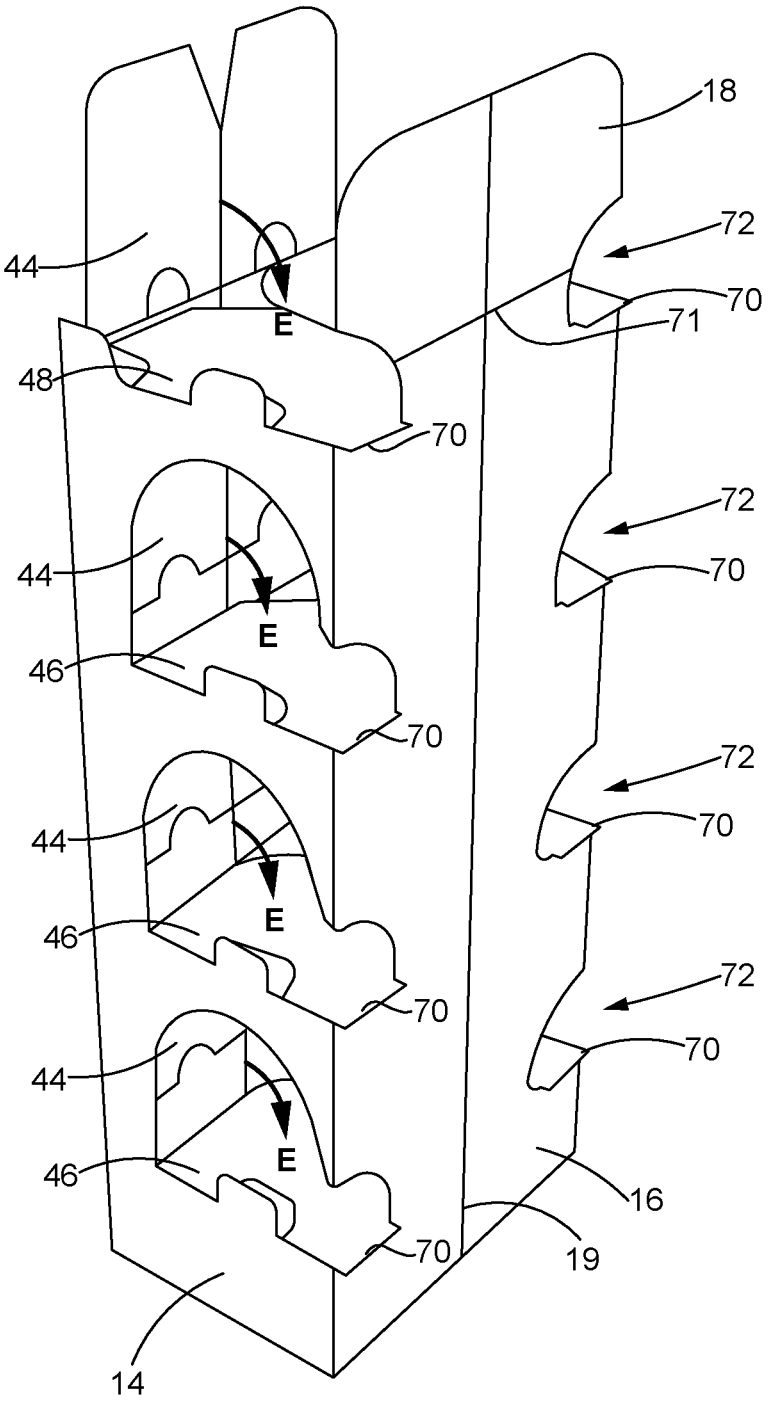
FIG. 10 is a rear perspective view of the upright structure of FIG. 9.

Finally, each front shelf panel 44 is pushed down individually in the direction of arrow E in FIG. 9 and FIG. 10 until the front shelf members 44 are in a horizontal orientation and the V-shaped cutout 58 of each front shelf panel 44 is locked into one of the notches 86 in the internal support 20. The display 10 is now fully assembled and appears substantially like the hutch 10 of FIG. 1.

INDUSTRIAL APPLICABILITY

The hutch 10 can be used to display any suitable product, in a retail setting or otherwise. The hutch is durable and can bear significant loads, especially if made of corrugated board. With knockdown scores on the front and rear panels, the hutch 10 can be folded into a compact configuration about half the size of some traditional hutches. Pillars along each corner and an internal support provide five vertical supports to hold products securely. The support halves 88 can be used to pull down the side shelf panels for fast and easy assembly. Together, the support halves 88 provide support for the back middle of each shelf 22.

It should be understood that the embodiments described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A display hutch comprising:

a front panel comprising a front body panel that defines a plurality of windows and one or more front shelf panels rotatably attached to the front body panel along front shelf fold lines;

a left side panel abutting the front panel along a left front corner, the left side panel comprising a left side body panel and one or more left side shelf panels, each left side shelf panel rotatably attached to the left side body panel along a side shelf fold line, the left side panel further comprising a left side glue tab hingedly attached to each left side shelf panel along a glue tab fold line extending parallel to the side shelf fold line;

a right side panel abutting the front panel along a right front corner, the right side panel comprising a right side body panel and one or more right side shelf panels, each right side shelf panel rotatably attached to the right side body panel along a side shelf fold line, the right side panel further comprising a right side glue tab hingedly attached to each right side shelf panel along a glue tab fold line extending parallel to the side shelf fold line;

a rear panel abutting the left side panel along a left rear corner and abutting the right side panel along a right rear corner;

one or more shelves, each shelf having a load bearing surface and comprising one of the front shelf panels and two of the side shelf panels; and an internal support located between the left side panel and the right side panel and comprising left and right support halves, the left support half adhered to each left side glue tab and the right support half adhered to each right side glue tab.

2. The display hutch of claim 1, wherein the hutch is moveable between a first position in which the support halves are spaced apart and a second position in which the support halves contact each other.

3. The display hutch of claim 1 wherein each front shelf panel has a free distal edge opposite the front shelf fold line that is supported by the internal support.

4. The display hutch of claim 1 wherein the internal support defines vertically spaced apart notches along a front edge and each front shelf panel defines a V-shaped cutout at its free distal edge that engages one of the internal support notches.

5. The display hutch of claim 1 wherein each side shelf panel includes a rearward extending side flange which is supported by the rear panel.

6. The display hutch of claim 1 wherein the rear panel defines cutouts having cutout edges that are co-linear with the side shelf fold lines, and each side shelf panel includes a rearward extending side flange which is supported by a cutout edge.

7. The display hutch of claim 1 wherein the front panel, left side panel, right side panel, rear panel and shelves are formed from a single folded unitary first blank.

8. The display hutch of claim 7 wherein the internal support is formed from two second blanks.

9. The display hutch of claim 1 wherein the front panel is vertically bisected by a front fold line and the rear panel is vertically bisected by a rear fold line.

10. The display hutch of claim 1 further comprising a glue panel foldably attached to a panel selected from the group consisting of the front panel, the left side panel, the right side panel and the rear panel and wherein the glue panel is affixed to a different panel selected from the group consisting of the front panel, the left side panel, the right side panel and the rear panel.

11. A method of assembling a display hutch comprising the steps of:

providing a display hutch comprising a front panel comprising a front body panel that defines a plurality of windows and one or more front shelf panels rotatably attached to the front body panel along front shelf fold lines; a left side panel abutting the front panel along a left front corner, the left side panel comprising a left side body panel and one or more left side shelf panels, each left side shelf panel rotatably attached to the left side body panel along a side shelf fold line, the left side panel further comprising a left side glue tab hingedly attached to each left side shelf panel along a glue tab fold line; a right side panel abutting the front panel along a right front corner, the right side panel comprising a right side body panel and one or more right side shelf panels, each right side shelf panel rotatably attached to the right side body panel along a side shelf fold line, the right side panel further comprising a right side glue tab hingedly attached to each right side shelf panel along a glue tab fold line; a rear panel abutting the left side panel along a left rear corner and abutting the right side panel along a right rear corner; one or more shelves, each shelf having a load bearing surface and comprising one of the front shelf panels and two of the side shelf panels; an internal support comprising left and right support halves, the left support half adhered to each left side glue tab and the right support half adhered to each right side glue tab; and a glue panel foldably attached to a panel selected from the group consisting of the front panel, the left side panel, the right side panel and the rear panel and wherein the glue panel is affixed to a different panel selected from the group consisting of the front panel, the left side panel, the right side panel and the rear panel;

applying adhesive to a second blank facing surface of each glue tab;

adhering one second blank to the glue tabs of the left side panel and adhere the other second blank to the glue tabs of the right side panel;

applying adhesive to a surface of the glue panel and adhering the glue panel to the rear panel to create a folded and glued structure;

positioning the folded and glued structure in an upright position and squaring up the structure;

rotating downwardly in unison the side shelf panels along the side shelf fold lines until the second blanks contact each other; and rotating downwardly each front shelf panel about front shelf fold lines until each front shelf panel is in a horizontal orientation.

* * * * *